US005273625A

United States Patent [19]

Antolovich

[11] Patent Number: 5,273,625

[45] Date of Patent: Dec. 28, 1993

[54] METHOD OF TREATING BLEACHED PULP ON A WASHER WITH CALCIUM IONS TO REMOVE SODIUM IONS

[75] Inventor: Edi Antolovich, Powell River, Canada

[73] Assignee: MacMillan Bloedel Limited, Vancouver, Canada

[21] Appl. No.: 844,323

[22] Filed: Mar. 2, 1992

Related U.S. Application Data

[63] Continuation-in-part of Ser. No. 624,220, Dec. 10, 1990, abandoned.

[51] Int. Cl.[5] ..... D21C 9/02

[52] U.S. Cl. ..... 162/60; 162/87; 162/181.2

[58] Field of Search ..... 162/181.2, 189, 60, 162/70, 87, 90

[56] References Cited

U.S. PATENT DOCUMENTS 3,029,181 4/1962 Thomsen ..... 162/189
3,567,574 3/1971 Braitberg et al. ..... 162/60
3,897,301 7/1975 Bauman et al. ..... 162/189

OTHER PUBLICATIONS

"Panorama of Papermaking Today", Westvaco Chart, Westvaco Corp. 1971.

Trinh et al, "Sodium Equilibrium In Kraft Pulp Washing", J. of Pulp & Paper Science, vol. 13, No. 3; May 1987, pp. 93-98.

Crotogino et al, "The Principles of Pulp Washing", Tappi J., Jun. 1987, pp. 95-103 (162-60).

*Primary Examiner*—Steve Alvo
*Attorney, Agent, or Firm*—C. A. Rowley

[57] ABSTRACT

Method for treating chemically treated cellulosic pulp that contains sodium ions wherein the pulp is subjected to an ion exchange with a cation (preferably calcium) having a higher valence than the sodium followed by washing of the sodium cations from the pulp and then forming the pulp containing the cations in an amount equivalent to at least 700 ppm of calcium ions into a sheet thereby to facilitate water removal and increase the production rate of the sheet forming machine.

3 Claims, No Drawings

METHOD OF TREATING BLEACHED PULP ON A WASHER WITH CALCIUM IONS TO REMOVE SODIUM IONS

This application is a continuation-in-part of application Ser. No. 07/624,220 filed Dec. 10, 1990 now abandoned.

TECHNICAL FIELD

The present invention relates to improving the drainage of pulp to increase the forming machine capacity. More particularly the present invention relates to replacing sodium ions in a pulp with a higher valence cation by an ion exchange process and then forming the pulp into a sheet or web.

BACKGROUND ART

There are a variety of different techniques for bleaching of say a kraft pulp that employ either sodium or calcium hypochlorite. Both processes have their respective advantages. The use of NaOCl permits easier process control, minimizes scaling, plugging and process upsets, and lowers maintenance costs.

The use of calcium based hypochlorite ($Ca(OCl_2)$) has the advantage of providing a significant improvement in drainage rate of the pulp thereby increasing production significantly.

When operating with sodium hypochlorite as a bleaching agent, attempts have been made to increase the drainage rate and thereby the production of the machine by adding drainage aids. Alum has proven effective to improve drainage but is undesirable as it depresses the pH level to the point where corrosion in the machine tends to occur and many customers have found the presence of alum in the product to be detrimental.

Other drainage aids have been tried and found ineffective or too costly to provide a commercial advantage.

It is also known to add $Ca^{++}$ ions to the head box to improve drainage, however the amount of $Ca^{++}$ ions necessary to show some improvement is significant and the $Cl^-$ ions that are carried to the forming machine result in a significant corrosion problem.

In all of the above cases where drainage improvement has been sought the additive is applied in the head box so that the $Na^+$ and $Cl^-$ ions are also present when the pulp as it is being formed.

BRIEF DESCRIPTION OF THE INVENTION

It is an object of the present invention to provide a method of treating pulp by ion exchange to improve productivity by facilitating water removal.

Broadly the present invention relates to a method of treating cellulose pulp comprising pretreating said pulp by application of sodium ions to the pulp, reducing the moisture content, subjecting said pulp to an ion exchange process to substitute cations having a higher valence than 1 for the sodium cation, washing said pulp to remove ions surrounding said pulp, feeding said pulp containing, said cations in an amount equivalent to the mole equivalent of at least 700 ppm of calcium ions to a web forming station and then forming said pulp into a sheet and pressing and drying said sheet.

Preferably the said substituted cation will comprise calcium cations.

Preferably said ion exchange process will comprise applying calcium chloride ($CaCl_2$) in an aqueous solution as a spray immediately following formation of mat on a washer and wherein said washing will apply a plurality of sprays of water onto said pulp mat following application of the calcium chloride on said washer.

BRIEF DESCRIPTION OF THE DRAWINGS

Further features, objects and advantages will be evident from the following detailed description on the preferred embodiments of the present invention taken in conjunction with the accompany drawings in which.

BEST MODE (SN) OF CARRYING OUT THE INVENTION

Figure 1:
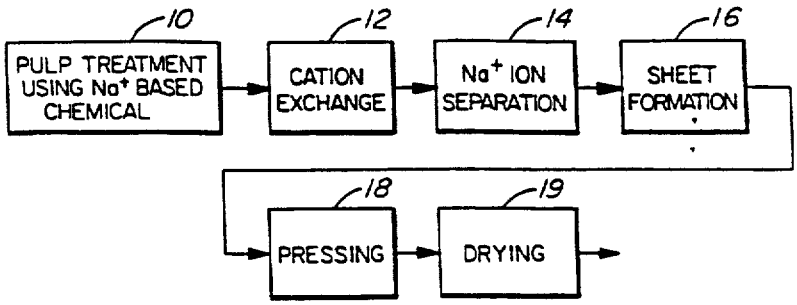
FIG. 1 is a schematic flow diagram for the process of the present invention.

As shown in FIG. 1, the basic steps of the present invention include pretreatment of pulp using a sodium based chemical, for example, sodium hypochlorite, sodium hydroxide or sodium sulphite, etc. for fibre liberation or bleaching of pulp as indicated at 10, followed by an ion exchange step 12 and then washing of the surrounding sodium ions from the pulp as indicated at 14, followed by sheet or web formation 16, pressing 18 and drying 19 of the formed sheet.

Figure 2:
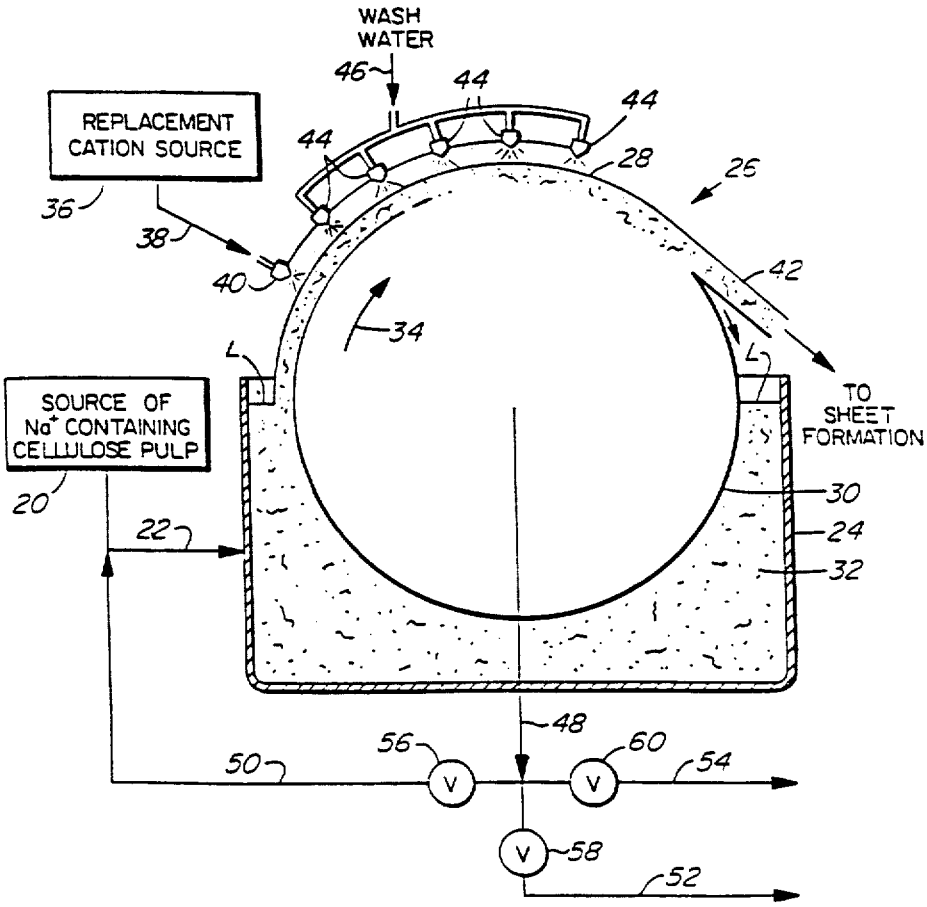
FIG. 2 shows a conventional drum type washer modified to carry out the present invention.

A practical system for implementing the ion exchange process is shown in FIG. 2. As shown, pulp from a source of pretreated which for practical purposes will be a bleached cellulose pulp containing sodium ions as indicated at 20 is fed via line 22 to the vat 24 of a drum type pulp washer 26.

A mat 28 is formed on the drum 30 of the washer 26 in the conventional manner by applying vacuum through the periphery of the drum 30 while it is submerged within the pulp bath 32 contained within the vat 24 and draws this mat 26 out of the bath 32 as the drum 30 rotates as indicated by the arrow 34.

A solution of a replacement cation is drawn from the source 36, passes via line 38 and is applied onto the formed mat 28 via a spray head 40. The spray head 40 is positioned adjacent the point where the mat 28 is drawn from the slurry 32, i.e. the spray head 40 is preferably the first spray head applicator to apply liquid to the mat 28 after it is formed. The liquid applied by spray 40 will preferably be a solution of the cations to be used to replace the sodium ions.

It is important that enough of the replacement cation be applied to the mat 28 to ensure that the mat 28 leaving the washing and containing the replacement cations as indicated at 42 contains as it is fed into the forming stage 16 sufficient of the cation to improve to drainage characteristics of the pulp.

After application of the solution of replacement cation the pulp mat 28 is subject to further washing by a plurality of nozzles 44 that apply wash water from the source 46 onto the pulp mat 28 in the conventional manner. The applied wash water passes through the mat 28 in a displacement type application and flows from the mat into the drum 30.

The interior of the drum 30 is maintained under negative pressure to draw the liquid applied via the nozzles 40 and 44 through the pulp mat 28 and into the drum 30. The liquid withdrawn from the drum 30 via line 48 is recirculated and reintroduced into the vat 24 via line 50 and a portion bled from the system via line 52 or directed to other areas of the process via line 54. The relative proportions of the materials in lines 50, 52 and 54 can be controlled as desired by appropriately adjusting the valves 56, 58 and 60 respectively.

It is important that the pulp fed to the forming section 16 contain sufficient of the replacement cations to ensure a significant increase in the drainage rate which equates to a significant increase in the speed at which the machine may be operated.

It has been noted that the limiting section when the pulp contains insufficient replacement cations is the press section and that pulp insufficient of the replacement cations tends to break up as the maximum acceptable speed is approached whereas when the pulp contains the replacement cations the speed before break up in the press is significantly higher as will be described hereinbelow with respect to FIG. 3 before the web tends to break up. Thus the addition of the required amount of replacement cations results in a significant increase in the speed of the machine.

The amount of replacement ions (valances higher than 1) necessary to obtain a reasonable increase in the maximum machine speed possible requires the mole equivalent of at least 700 ppm of calcium, preferably more than 800 ppm to reduce the sodium content to less than about 600 ppm, i.e. if calcium chloride is the additive the calcium content of the pulp entering the forming section 16 should be at least 700 ppm and generally would not exceed about 1200 ppm. If magnesium ions were used in place of the calcium ions the amount of magnesium ions present should be the mole equivalent of the number of calcium ions require, i.e. for magnesium ions a minimum of about 420 ppm would be used.

EXAMPLE 1

In a mill trial pulp was pretreated by using sodium hypochlorite in the conventional manner to develop the desired brightness in the brightened kraft pulp. This brightened pulp was then fed to a washer and then to a web forming machine in the conventional manner during normal production.

In the trial, when applying the present invention six kilograms per air dry tonne of pulp of calcium chloride was added to the washer in the manner as indicated in FIG. 1, i.e. through the first nozzle 40 on the drum washer 30 and washing was then carried out in the conventional manner to displace the sodium ions and other materials from the pulp. This pulp was then formed into a mat in the same way as was used for conventional production. The concentration of $CaCl_2$ in the spray applied by nozzle 40 was low (in the order of about 1 to 3% $CaCl_2$ by weight in the water).

Figure 3:
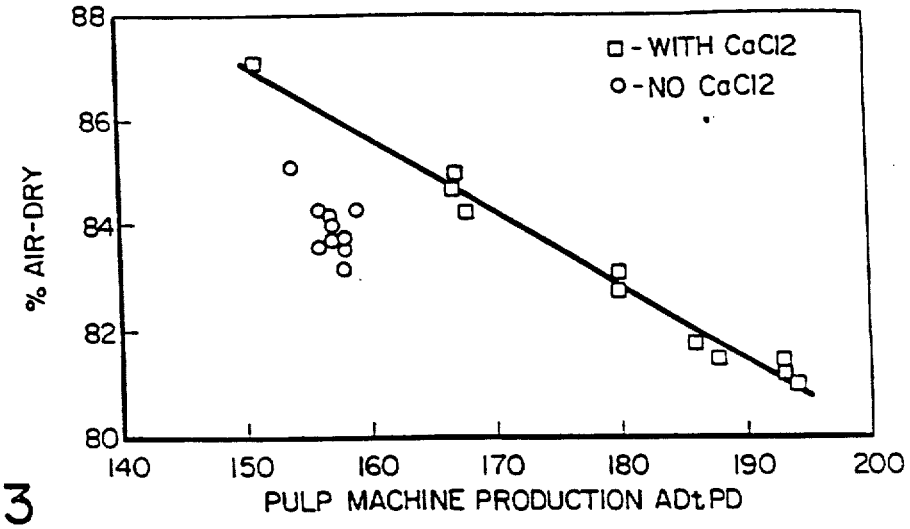
FIG. 3 is a graph that illustrates the change in production rate obtained when the present invention was applied to a specific pulp.

The results of the displacement of the sodium ions by calcium chloride addition are compared with no calcium chloride addition (the conventional process) in FIG. 3.

It will be evident that when no calcium chloride is added as indicated by the graph (open hexagons) the pulp production from the machine reached about 160 air dry tons per day at a percent dryness of 83% whereas at the same dryness when the present invention was applied (6 kg $CaCl_2$/Ad tonne of pulp) the production was about 175 air dry tons per day and more importantly at 81% per air dry the production rate with calcium chloride addition increased to about 190 tons per day for an increase of between 30 to 40 tons per day from the same equipment when the $Ca^{++}$ ions are used to replace the $Na^{+}$ ions.

When $Na^{+}$ ions were not replaced the capacity of the machine was reduced by the inability of the press 18 to squeeze water from the sheet without breaking the sheet.

Figure 4:
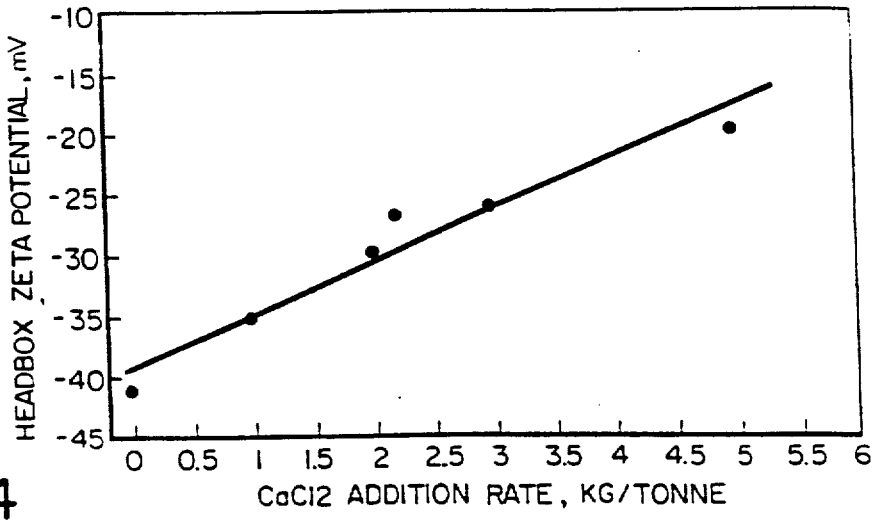
FIG. 4 is a graph of zeta potential versus the amount of calcium chloride addition and FIG. 5 is a graph showing the depletion of sodium ions and increase in calcium ions as the calcium chloride addition rate was increased.

It is believed that the zeta potential of the pulp has a bearing on the drainage rate of the pulp. Referring to FIG. 4 it can be seen that as the calcium chloride addition rate increased from 0 to 6 kilograms per tonne the zeta potential of the pulp in the pulp machine headbox increased from −40 mv to about −15 mv thereby indicating that a significant increase in drainage rate might be expected. More important it is believed the use of the higher valence Ca ions decreased the amount of swelling of the fibre and thus improved the operation of the press 18.

Figure 5:
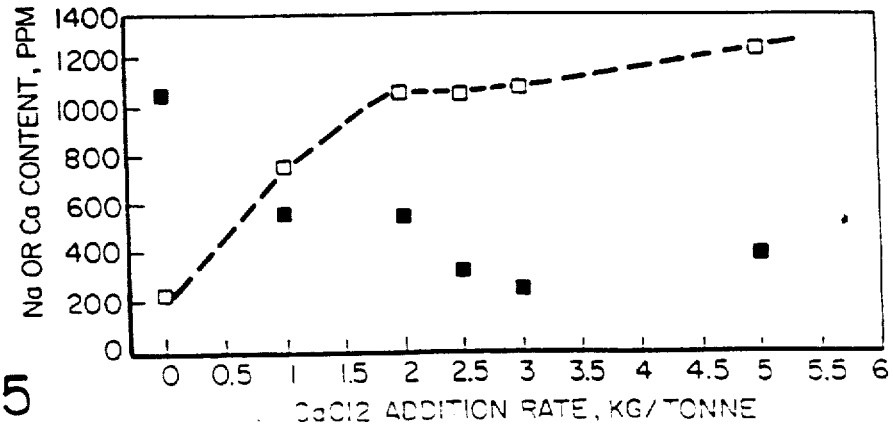

The amount of calcium and sodium remaining in the sheet on leaving the washer, i.e. carried in the mat 42, to the former is shown in FIG. 5. It will be apparent that the amount of calcium as indicated by the dash line curve increases at a dramatic rate up to about a two kilogram per tonne rate of addition and then seems to remain substantially constant, indicating that the total pick-up of calcium remains about the same for any additions of above approximately 2-3 Kg/tonne while the proportion of sodium ions diminishes gradually up to about a 3 kilogram per ton addition of calcium chloride and thereafter seems to gradually increase or remain substantially constant.

The above experiments have been carried out using calcium chloride, however other suitable ion exchange materials may also be used provided they have a higher valence than the sodium and the ion exchange can be effected in the pulp. The use of materials that change the pH of the stock, e.g. reduce the pH of the stock to render the stock corrosive should be avoided. As above indicated the use of alum falls within this category thus it is preferred not to use aluminium in this form even though it is quite effective in reducing the zeta potential of the pulp unless the detrimental effects can be eliminated by adding the $Al^{++}$ in a more appropriate form. Other suitable soluble polymeric or inorganic cations having valences of two or more such as magnesium may be used if properly applied. Similarly the calcium cation need not be added in the form of calcium chloride, it is only important that the calcium or other cation to be used in the substitution reaction be readily available, e.g. be in solution in the liquid applied via the spray 40 and not be detrimental to an unacceptable degree to pulp properties or to the equipment being used.

TABLE 1

| | No Calcium Chloride Ion Exchange Treatment | Treated with Calcium Chloride |
|---|---|---|
| Mould Vacuum ("Hg") | 20 | 17.6 |
| Headbox pH | 6.5-6.6 | 6.0-6.6 |
| Zeta Potential | −30 mv Range | −16 mv |
| % B.D. Going Into the Pulp Dryer | 51.1 | 52.1 |
| After the Dryer - Ream Wt. | 1145-1175 | 1405-1485 |

TABLE 1-continued

| | No Calcium Chloride Ion Exchange Treatment | Treated with Calcium Chloride |
|---|---|---|
| lb/3,000 sq. ft. | | |
| % A.D. | 83.2-85.1 | 81.0-81.8 |
| Production (ADtPD) | 157 | 190 |

As shown in Table 1, when no calcium chloride ion exchange treatment was applied via the nozzle 40, the zeta potential of the pulp was about −30 mv. The dryness of the pulp sheet going to the dryer (after formation) was about 51% and the ream weight of the pulp was between 1145 and 1175 lb/3,000 sq.ft., generating a production rate of approximately 157 tons per day at a percent air dried of 82 to 85. Under the same conditions when the pulp was treated with about 6 kilograms of calcium chloride in a dilute solution per air dry tonne pulp, the headbox pH was about the same, however the zeta potential was −16 mv, showing a significant increase, the dryness of the pulp fed to the dryer was essentially the same, i.e. 52% bone dry but after the dryer, the ream weight increased significantly, and the total production increased to 190 air dry tons per day (ADTPD) at 81-82% are dried or an increase of over 30 air dry tons per day.

Based on the above, an addition of calcium chloride in the range of about 2-5 kilograms per tonne of pulp, oven dry, is preferred, i.e. about 1 to 3% $Ca^{++}$ ions based on the dry weight of the pulp.

Having described the invention, modifications will be evident to those skilled in the art without departing from the spirit of the invention as defined in the appended claims.

I claim:

1. The method of treating cellulose pulp comprising bleaching said pulp by application of bleaching agent containing sodium ions to the pulp, to provide a bleached pulp forming a mat of said bleached pulp on a washer, subjecting said bleached pulp to an ion exchange process by applying calcium cations in an aqueous solution as a spray immediately following formation of said mat on said washer, said calcium cations being applied to said pulp in an amount of 1 to 3% $Ca^{++}$ ions based on the air dried weight of said pulp, then apply washing liquor to said mat of said bleached pulp to produce washed pulp containing significantly less sodium ions than said bleached pulp, feeding said washed pulp containing said $Ca^{++}$ ions in an amount of at least 700 ppm calcium ions to a former, and forming said pulp into a sheet, pressing said sheet containing said cations and then drying said sheet.

2. A method as defined in claim 1 wherein said calcium cations are applied by applying a solution of calcium chloride to said pulp.

3. A method as defined in claim 2 wherein said calcium chloride is applied in the amount of 2 to 5 kg/air dried tonne of pulp.

* * * * *

UNITED STATES PATENT AND TRADEMARK OFFICE

CERTIFICATE OF CORRECTION

PATENT NO. : 5,273,625

DATED : December 28, 1993

INVENTOR(S) : Edi Antolovich

It is certified that error appears in the above-indentified patent and that said Letters Patent is hereby corrected as shown below:

Title page, "No Drawings" should read--2 Drawing Sheets--.

Drawing Sheets (2) consisting of figures 1-5, should be inserted as per attached sheets.

Signed and Sealed this

Eleventh Day of October, 1994

*Attest:*

*Attesting Officer*

BRUCE LEHMAN

*Commissioner of Patents and Trademarks*